US006439991B1

(12) United States Patent
Jarnot

(10) Patent No.: US 6,439,991 B1
(45) Date of Patent: Aug. 27, 2002

(54) ONE PIECE LOUVER VENT

(75) Inventor: Frank R. Jarnot, Lantana, FL (US)

(73) Assignee: Airlette Mfg. Corporation, Lantana, FL (US)

( * ) Notice: Subject to any disclaimer, the term of this patent is extended or adjusted under 35 U.S.C. 154(b) by 0 days.

(21) Appl. No.: 09/945,673

(22) Filed: Sep. 5, 2001

(51) Int. Cl.[7] ..... F24F 7/02

(52) U.S. Cl. ..... 454/118; 135/93; 454/79; 454/82; 454/367

(58) Field of Search ..... 454/78, 79, 80, 454/82, 88, 94, 115, 118, 136, 162, 367; 2/DIG. 1; 135/93, 94

(56) References Cited

U.S. PATENT DOCUMENTS

| | | | | | |
|---|---|---|---|---|---|
| 3,062,125 | A | * | 11/1962 | Henneberger | 454/147 |
| 3,345,932 | A | | 10/1967 | Sauer | |
| 3,618,161 | A | | 11/1971 | Nozawa | 16/150 |
| 3,892,169 | A | | 7/1975 | Jarnot | |
| 4,158,902 | A | | 6/1979 | Chernack et al. | 16/150 |
| 4,184,414 | A | | 1/1980 | Jarnot | |
| 4,537,119 | A | | 8/1985 | Jarnot | |
| 4,759,270 | A | * | 7/1988 | Lindeen | 403/408.1 |
| 4,898,085 | A | | 2/1990 | Jarnot | |
| 5,328,405 | A | | 7/1994 | Jarnot | 454/78 |
| 5,759,098 | A | | 6/1998 | Jarnot | 454/275 |
| 6,145,688 | A | * | 11/2000 | Smith | |

* cited by examiner

*Primary Examiner*—Harold Joyce
(74) *Attorney, Agent, or Firm*—Jacobson Holman, PLLC

(57) ABSTRACT

A vent enabling passage of air through a flexible cover such as those used to cover a boat, automobile, truck payload, stored materials at industrial sites, retail outlet outlets and the like. More specifically, the vent is of one piece unitary construction and includes an annular base secured to the flexible cover by adhesive or other conventional securing structure with the base including a central opening aligned with an opening in the flexible cover. The vent further includes a dome shaped louvered cover hingedly connected to the base and oriented in overlying relation to the base with the louvers enabling air passage through the cover and base for circulation of air in relation to the space covered by the flexible cover on which the vent is mounted. A retaining wall extends inwardly and upwardly from the base around the central opening to prevent water from entering the opening.

20 Claims, 3 Drawing Sheets

ONE PIECE LOUVER VENT

BACKGROUND OF THE INVENTION

1. Field of the Invention

The present invention generally relates to a vent and, more specifically, vent construction which is mounted on a flexible cover such as those used to cover a boat, automobile, truck payload, stored materials at industrial sites, retail outlets and the like in order to enable air and moisture to circulate through the flexible cover. The vent is of one piece construction and includes an annular base secured to the flexible cover by adhesive or other conventional securing structures with the base including a central opening aligned with an opening in the flexible cover. The vent also includes a dome shaped louvered cover hingedly connected to the base and oriented in overlying relation to the base with the louvers enabling air passage through the cover and base for circulation of air in relation to the space covered by the flexible cover on which the vent is mounted.

2. Description of the Prior Art

When storing or protecting various items, products, commodities or the like, a flexible water impermeable cover of plastic or similar material is typically positioned in overlying or enclosing relation to the protected items. Inasmuch as it is desirable to provide ventilation for the spaces covered or enclosed by such a flexible cover, various ventilation structures have been developed. Some of the known vent structures can be quickly and easily attached to the flexible cover and include structures which enable passage of air through the cover. I have developed various vent structures for this purpose as disclosed in my prior U.S. Pat. Nos. 3,892,169, 4,184,414, 4,537,119, 4,898,085, 5,328,405 and 5,759,098.

While my prior patents disclose various structures which function satisfactorily, the present invention represents significant improvements in the prior art and, in particular, represent significant improvements in my prior U.S. Pat. No. 4,537,119.

SUMMARY OF THE INVENTION

The vent of the present invention is of one piece construction molded from plastic material. The vent includes a base and dome shaped louvered cover hingedly interconnected at adjacent edge points by a plastic hinge, thus forming a single unitary construction of both the base and cover. This unitary construction enables the base, cover and hinge to be molded in a straight line relationship and multiple vents can be stacked in a nested condition in which they are partially housed within each other thereby providing a more convenient and compact arrangement. This nesting capability facilitates the storage, transportation and display of the vent of the present invention. Further, the one piece construction of the base, hinge and cover enables the cover to be easily pivoted into overlying relation to the base, and the base and cover include interacting structures for snap engagement of the cover with the base to retain the cover in overlying relation to the base.

The dome shaped cover of the vent of the present invention includes multiple louvers, preferably three, which are spaced to form slot openings to permit maximum venting or air flow through the cover, while at the same time the louvers provide an external water shedding effect. Also, the dimensions of the slot openings formed by the louvers are of a size to discourage entry of debris, rodents or the like through the vent to protect the interior of the space or enclosure covered by the flexible cover while still maintaining maximum ventilation and air flow. The louvers and slot openings formed by the louvers located on the peripheral side surfaces of the dome shaped cover eliminate the necessity of a screen associated with the top of the vent cover and also eliminate the necessity of a baffle component to shelter the vent central opening from rain and water entry such as those components disclosed in my '119 patent.

The base of the vent includes a central opening or aperture aligned with an opening in the flexible cover in the same manner as in my '119 patent. The base of this invention includes an upstanding circular retaining wall surrounding the central vent opening in the base with the retaining wall extending for a height which will allow the vent of the present invention to be mounted or installed in horizontal areas where water accumulation or puddling occurs up to a depth of approximately ½ inch. The retaining wall prevents water entry into the central vent opening in the base to maintain a water tight seal under such conditions.

The integral hinge between the base and cover permits the cover to be folded over and snap engaged with the base. The hinge includes a narrow strip preferably having multiple indentations, preferably three, located on its underside, or outerside when folded over. The indentations partially relieve the strain within the hinge strip when the cover is folded over and secured to the base. The indentations allow the hinge strip to fold in a more circular manner thereby relieving or avoiding fatigue factors in the components of the hinge. The base preferably includes upstanding hinge guides placed in an area to direct the hinge strip and cover to align properly with the base when it is folded over during installation and engagement of the cover with the base. The hinge guides also protect the hinge area from accidental damage from physical encounters with other objects.

The one-piece cover and base include a snap type locking system spaced circumferentially, preferably 120° apart, to secure the cover in overlying relation to the base. The locking system includes locking members on the base which project upwardly from the periphery thereof and outwardly projecting flexible cover locking projections on the periphery of the cover for snap locking engagement with the rigid base locking members on the base. The dome shaped cover includes locking tabs adjacent the cover locking projections to retract the cover locking projections from the rigid base locking members to enable the dome shaped cover to be released if pivotal movement of the cover for opening the vent is desired.

The plurality of louvers defining slot openings in the dome shaped cover are preferably overlapping each other to shed water while the slot openings provide for air flow. The interior of the cover is provided with reinforcing ribs in peripherally spaced relation on the interior surface with three of the ribs forming continuations of the cover locking projections and the other three ribs oriented in equally spaced relation. The ribs function to rigidify the dome shaped cover.

In view of the foregoing, it is an object of the present invention to provide a louver vent for installation onto a flexible cover such as a shrink film used to enclose products, articles of manufacture and the like during storage, transportation and display in which the vent includes a one piece base and cover hingedly connected together and molded from plastic material.

Another object of the present invention is to provide a one piece louver vent constructed in a manner to enable multiple vents to be stored in stacked or partially nested relationship to provide a more convenient and compact arrangement of the vents for storage, shipment and display.

A further object of the present invention is to provide a louver vent in accordance with the preceding objects in which the base and cover are hingedly interconnected by an integral plastic hinge of unitary construction with the base and cover.

Still another object of the present invention is to provide a louver vent including a base and cover in which the cover is of dome shape and provided with a plurality of louvers spaced from each other and to define slot-like openings for air circulation, but are of a size and shape to preclude entry of debris and animals.

Still a further object of the present invention is to provide a louver vent including a base and dome shaped cover with a plurality of louvers oriented to shelter a central vent opening in the base and aligned opening in the flexible film cover to prevent entry of rain water through the aligned openings.

A still further object of the present invention is to provide a louver vent in accordance with the preceding objects in which the central opening in the base is surrounded by a laterally extending wall projecting into the dome shaped cover to prevent entry of water even when the louver vent is positioned where water can collect or puddle to a depth less than the height of the wall.

Yet another object of the present invention is to provide a one piece louver vent in accordance with the preceding objects in which the unitary plastic hinge interconnecting the base and cover includes a narrow plastic strip having transverse indentations on a surface thereof to provide a circular curling action of the hinge strip when the dome shaped cover is pivoted into overlying engagement with the base.

Yet a further object of the present invention is to provide a louver vent in accordance with the preceding objects in which the base is provided with spaced upstanding hinge guides to guide movement of the cover and hinge strip when the cover is moved to a position in covering relation to the base.

An additional object of the present invention is to provide a louver vent in accordance with the preceding objects in which a novel locking system is utilized to enable snap engagement of the dome shaped cover with the base when the dome shaped cover is folded over into overlying engagement with the base.

Still another additional object of this invention to be specifically enumerated herein is to provide an one piece louver vent in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, and reference being had to the accompanying drawings forming a part hereof, wherein like numerals refer to like parts throughout.

BRIEF DESCRIPTION OF THE DRAWINGS

FIG. 2 is a side elevational view, with portions broken away, of the vent shown in FIG. 1, with the dome shaped cover in open position illustrating the one piece construction of the vent and the capability of stacking or partially nesting the vents in compact relation for shipment, storage and the like.

BRIEF DESCRIPTION OF THE PREFERRED EMBODIMENT

Figure 1:
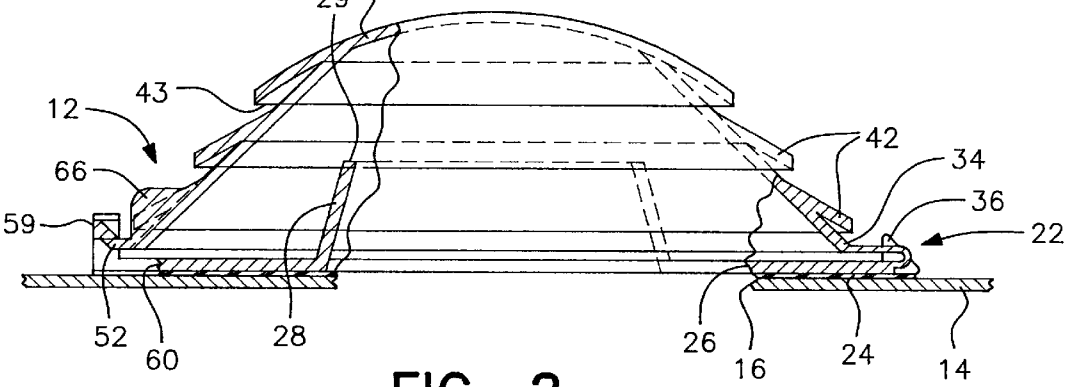
FIG. 1 is a side elevational view of the preferred embodiment of the louver vent of the present invention with portions broken away illustrating the components of the vent when in installed position on a flexible film or enclosure.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Referring to the drawings, the louvered vent of the present invention is generally designated by reference numeral 12. In FIG. 1, the vent 12 is illustrated in installed position on a flexible cover 14 of shrink film plastic, other plastic materials or other flexible water repellant covers used to protect various items, products, articles, commodities or the like during storage outdoors to protect the covered items from rain or other weather conditions. The flexible cover 14 includes an opening 16 with which the louvered vent is associated to enable air flow or circulation through the opening 16.

Figure 2:
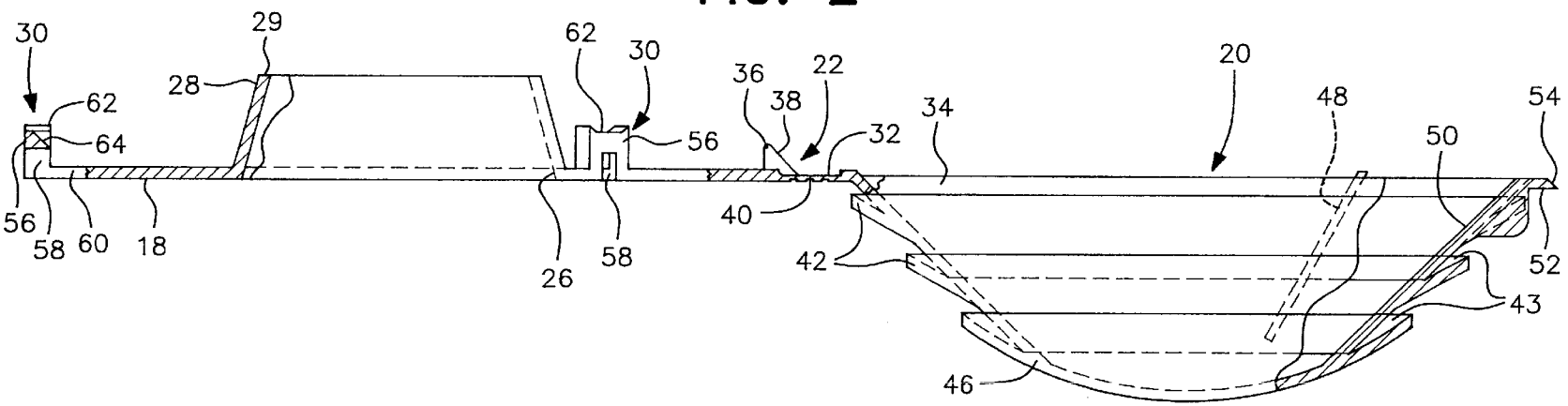
Figure 3:
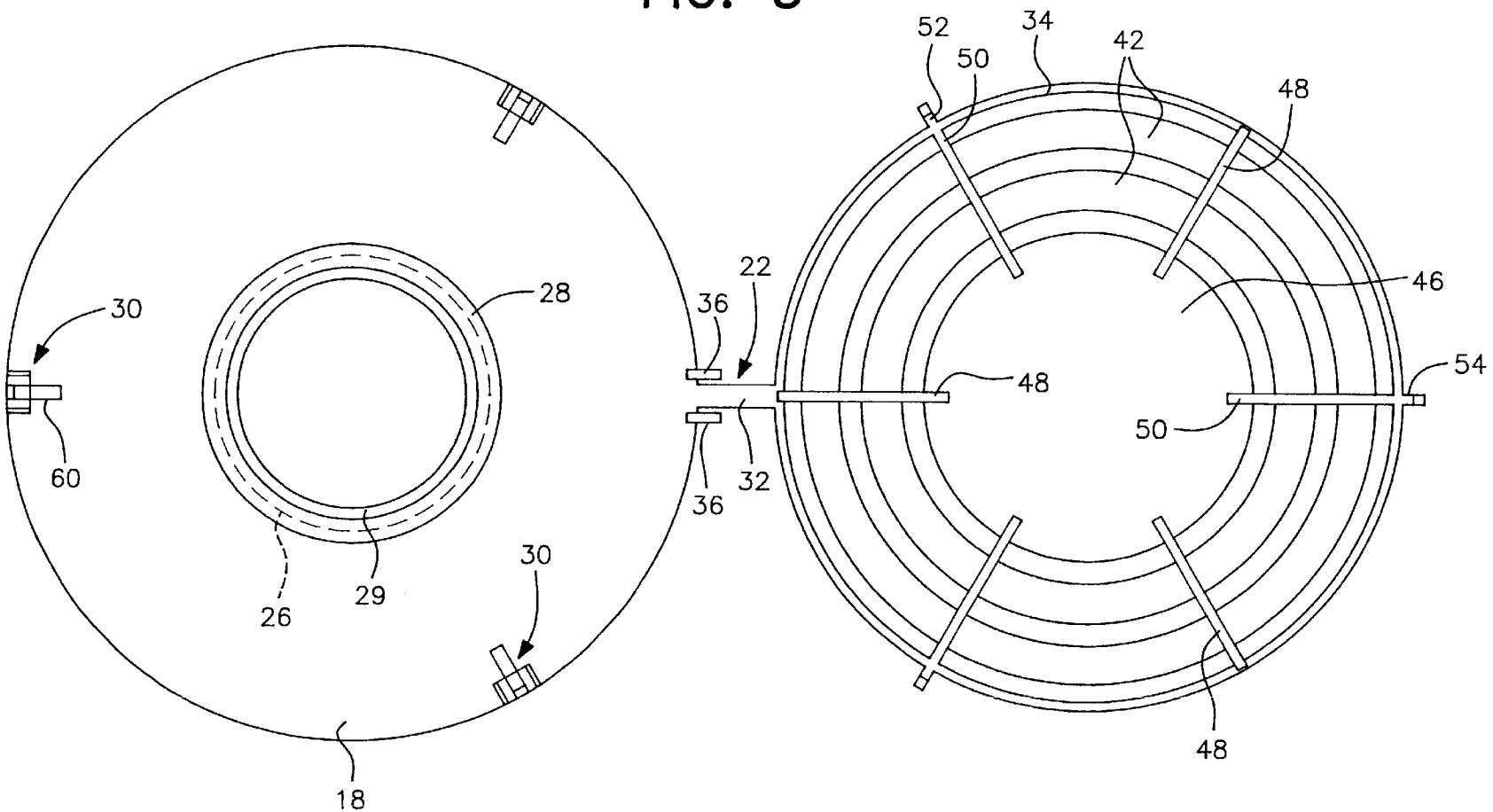
FIG. 3 is a top plan view of the vent as illustrated in FIG. 2 illustrating structural details of the base and dome shaped cover components of the vent.

The louvered vent 12 includes a base 18 having flat upper and lower surfaces and a central circular opening 26 which generally mates with opening 16 in cover 14. The base 18 is preferably annular in configuration as shown in FIG. 3. The louvered vent 12 also includes a dome shaped cover 20 which is molded in one piece with the base 18 and a narrow connecting hinge, generally designated by reference numeral 22. The hinge 22 connects the cover 20 to the base 18 at adjacent edge portions for movement of the dome shaped cover 20 from a position in lateral alignment with the base 18 as illustrated in FIG. 2 to an installed position in which the dome shaped cover 20 overlies and engages the top surface of the base 18 as illustrated in FIG. 1.

The base 18 is attached to the flexible cover 14 by pressure sensitive adhesive 24, or other suitable attaching mechanism, which enables the substantially rigid but somewhat flexible plastic base 18 to be quickly and easily attached to the flexible cover 14. Central vent opening 26 of the base 18 has a generally circular retaining wall extending upwardly from the base in alignment with the central vent opening 26. The retaining wall 28 preferably inclines inwardly and vertically upwardly to prevent passage of water downwardly through the central vent opening 26 as long as the water level is below the top of the retaining wall.

The base 18 also includes three equally spaced, substantially rigid base locking members, generally designated by reference numeral 30, around the periphery of the base 18 as illustrated in FIG. 3. Also, the plastic hinge 22 includes a hinge strip 32 that is integrally formed with an edge portion of the base 18 and is equally spaced from a pair of the rigid base locking members 30 as shown in FIG. 3. The hinge strip 32 is also integral with a lower peripheral edge 34 of the dome shaped cover 20 at one edge thereof to link and hingedly connect the cover 20 to the base 18. The hinge strip 32 enables the cover 20 to pivot from the position alongside the base 18, as illustrated in FIG. 2, to a position in which the cover 20 overlies the base 18, as illustrated in FIG. 1, which is the position of these components when the louvered vent 12 is installed on the flexible cover 14 with the central vent opening 26 in the base 18 in alignment with the opening 16 in the flexible cover 14.

Figure 5:
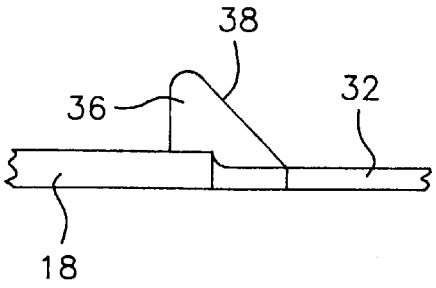
FIG. 5 is a fragmental detailed elevational view of an edge portion of the base illustrating the hinge guides thereon.
Figure 6:
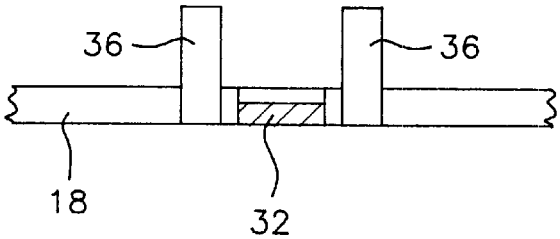
FIG. 6 is a fragmentary edge view of the hinge guides illustrating the association of the hinge guides with the hinge strip.
Figure 7:
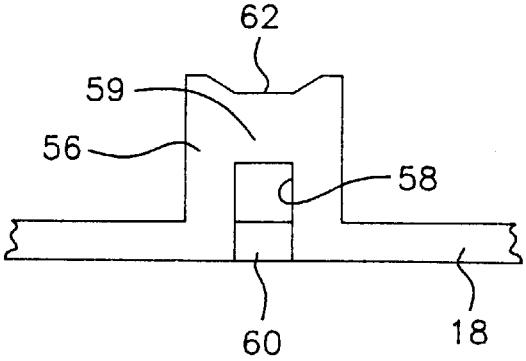
FIG. 7 is a detailed elevational view of one of the locking members on the base which are engaged by locking projections on the dome shaped cover.

The base 18 includes a pair of upwardly projecting hinge guides 36 which project upwardly and outwardly from the peripheral edge of the base with the hinge strip 32 extending between the hinge guides 36 as illustrated in FIGS. 3, 5 and 6. Each hinge guide includes an inclined edge 38 facing outwardly from the base and facing the hinge strip 32 as the hinge strip is folded into a generally U-shaped configuration, as illustrated in FIG. 1, when the dome shaped cover is pivoted from the position illustrated in FIG. 2 to the position illustrated in FIG. 1. Placement of the hinge guides 36, as illustrated, permits and directs the cover 20 to be properly aligned with the base when it is folded over during installation and attachment of the cover to the base. The hinge guides 36 also protect the hinge area after installation from damage due to encounters with various objects.

Figure 4:
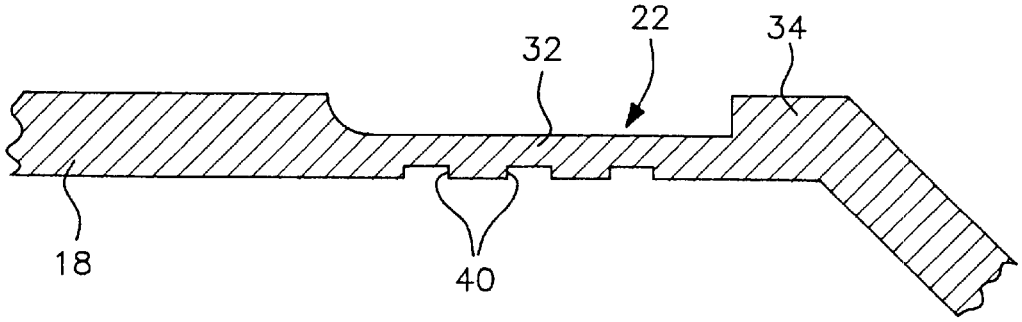
FIG. 4 is a detailed sectional view, on an enlarged scale, of the integral hinge strip interconnecting the base and the cover and illustrating indentations in the bottom surface.

As illustrated in FIG. 4, the hinge strip 32 preferably includes a plurality of longitudinally spaced indentations 40 on the lower surface thereof when in the position of FIG. 2 and on the outer surface when the hinge strip is folded into horizontal U-shaped configuration as shown in FIG. 1. The indentations relieve strain or stress on the hinge strip 32 when the cover 20 is folded over for the purpose of securing the cover 20 to the base 18 and allows the hinge to fold in a more circular or curling manner thereby relieving or avoiding fatigue factors in the hinge. The hinge is preferably constructed of plastic material, such as polypropylene, or the like and in the form of a "living" hinge, the function of which is well known in the art.

The dome shaped cover 20 includes a plurality of spaced louvers 42 supported from a continuous peripheral lower edge 34. The uppermost louver is in the form of a dome 46 whereas the lower two louvers 42 are peripheral flanges with the edges of the louvers 42 overlapping to shed water while permitting air flow by virtue of the slot openings 43 between the louvers 42. The louvers 42 and the dome 46 are supported from each other and from the peripheral lower edge 34 of the cover 20 by a plurality of circumferentially spaced reinforcing ribs 48 and 50. The ribs 48 interconnect the inner edges of the louvers 42 and the underside of the edge of the dome 46 with the peripheral edge 34 of cover 20. One of the ribs 48 is preferably aligned with the hinge strip 32 where it connects with the dome 20 and the other ribs 48 are equally spaced circumferentially around the louvers 42 and dome 48. The reinforcing ribs 50 are also preferably spaced equally from each other and spaced equally from the ribs 48, as illustrated in FIG. 3, but the ribs 50 have a lower end extending beyond the lower peripheral edge 34 of the cover 20. The ribs 50 terminate at their lower ends in cover locking projections 52 in the form of tabs which have an inclined outer edge 54 as illustrated in FIGS. 1 and 2.

The louvers 42 including the dome 46 are spaced vertically from each other and the inner and outer diameters of the louvers decrease upwardly. The ribs 48 and 50 maintain the spacial relationship of the louvers and dome to provide relatively narrow slot openings 43 between the two louvers and the top louver and the dome to shed water but permit air flow. The slot openings 43 are sufficiently narrow to preclude the entry of debris, rodents or the like. As illustrated in FIG. 1, the retaining wall 28 extends a vertical distance generally to a position approximately in alignment with the lower edge of the second louver 42 and inwardly such that its top edge 29 is spaced inwardly of the most inward louvered opening 43. This arrangement helps to prevent rain water entering the vent from passing downwardly through the central vent opening 26. Further, the retaining wall 28 protects the central vent opening to enable the louvered vent of the present invention to be installed in areas where there may be an accumulation of water or puddling of water to maintain the water tight integrity of the vent as long as the water level is below the top edge 29 of the retaining wall 28.

The locking projections 52 at the lower ends of ribs 50 extend laterally outwardly and cooperate with the base locking members 30 at the periphery of the base 18. Each base locking member 30 includes an upstanding rectangular member 56 which defines a vertical slot or notch 58 extending from the lower surface of the base 18 to a position generally midway of the height of the base locking member 30. Also, an inwardly extending slot 60 extends inwardly a short distance from the periphery of the base 18 and is in communication with the vertical slot 58 in the upstanding member 56. The top section 59 of the rectangular member 56 defines the top of slot 58 and preferably includes a recess 62 on its upper edge which functions to guide the locking projection 52 to a centralized position when it engages the upper surface of the upstanding member 56. The upwardly facing inner surface of the top section 59 of the upstanding member 56 is preferably provided with a slanted or inclined surface 64. This surface 64 engages the inclined surface 54 on the cover locking projections 52 during assembly to serve to cam the projections 52 as they are moved downwardly past the inclined surfaces 64 so that the locking projections 52 will pass the inclined surfaces 64 and spring back outwardly for engagement with the underlying surface of the top section 59 as illustrated in FIG. 1.

The upper surface of the lowermost louver 42 includes three equally spaced upwardly and outwardly extending locking tabs 66 which are aligned with the cover locking projections 52. The locking tabs 66 facilitate the placement of the cover locking projections 52 under the rigid base locking member 30 by applying an inward physical force to the locking tab 66 in the direction of the central vent opening 26 in the base 18. The tabs 66 provide a structure for engaging the cover locking projections 52 with the base locking members 30 and also enables disengagement if it becomes desirable to pivot the dome shaped cover 20 away from the base 18 to a position to provide access to the central opening 26 in the base or the opening 16 in the flexible cover 14.

The one piece unitary construction and configuration of the louvered vent of the present invention enables an efficient molding operation and also enables louvered vents to be stacked in a partially nested relationship. A nested stacking enables a large number of stacked louvered vents of the present invention to be compactly packaged for storage and distribution to users. When ready for use, the vent is readily installed on a flexible cover 14 by merely attaching the pressure sensitive adhesive on the bottom of base 18 to the flexible cover with the central vent opening 26 aligned with a preformed opening 16 in the flexible cover 14. If preferred, the base member 18 can be adhesively attached to the flexible cover 14 and the opening 16 in the flexible cover can be formed by a knife or other cutting implement utilizing the central vent opening 26 in the base 18 as a guide to form the opening 16.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A vent for mounting on a panel having an opening therein, said vent comprising an base adapted to be mounted on said panel, said base including a vent opening for alignment with the opening in the panel, a cover mounted in overlying relation to the vent opening in the base, said base and cover being constructed of one piece construction, a hinge pivotally connecting a peripheral portion of the cover to a peripheral portion of the base, a locking structure interconnecting the base and cover for securing the cover in overlying relation to the base, said cover including at least one peripheral louver defining a slot opening to enable air flow through the cover, vent opening in the base and opening in the panel.

2. The vent as defined in claim 1, wherein said hinge is constructed of molded plastic material of unitary construction with the base and cover.

3. The vent as defined in claim 1, wherein said base is an annular configuration and said cover is of dome shaped configuration and are molded together in one piece construction with the dome shaped cover and base being laterally aligned and connected by the hinge when formed.

4. The vent as defined in claim 3, wherein said base includes an upstanding retaining wall of annular configuration and connected with a periphery of said vent opening in the base to preclude passage of water through the vent opening in the base thereby enabling installation of the vent in areas where water may accumulate or puddle to a depth less than the distance between the base and an end of the retaining wall.

5. The vent as defined in claim 1, wherein said base includes adhesive material for attaching the base to the panel, said opening in the panel being formed selectively prior to attaching the base to the panel or subsequently to attachment of the base to the panel by using the vent opening in the base as a guide to form the opening in the panel.

6. The vent as defined in claim 1, wherein said cover is dome shaped, said dome shaped cover including multiple spaced louvers to define multiple slot openings for air flow therethrough.

7. The vent as defined in claim 6, wherein said dome shaped cover includes a dome shaped member forming an upper surface of said cover with a peripheral edge of the dome member defining an upper louver.

8. The vent as defined in claim 7, wherein said louvers are spaced apart and supported by internal reinforcing ribs extending from the dome shaped member to a lower peripheral edge of said cover.

9. The vent as defined in claim 8, wherein said louvers decrease in circumference from a lowermost louver to the peripheral edge of the dome member.

10. The vent as defined in claim 1, wherein said locking structure to secure the cover in overlying relation to the base includes an upstanding lock member on the periphery of the base, a projecting locking tab on the periphery of the cover, said cover and tab being sufficiently flexible to enable the locking tab to lockingly engage the locking member.

11. The vent as defined in claim 1, wherein said hinge is constructed of plastic material unitary with the base and cover, said hinge including a narrow plastic strip interconnecting a periphery of the base and a periphery of the cover and being configured in U-shaped configuration when the cover is pivoted to a position overlying the base.

12. The vent as defined in claim 11, wherein said hinge strip includes at least one transverse indentation on the exterior surface thereof when formed in U-shaped configuration to relieve strain and stress in the plastic strip.

13. The vent as defined in claim 12, wherein said base includes a pair of spaced hinge guides on a periphery thereof with the hinge guides straddling the hinge strip for guiding movement of the hinge strip and cover when the cover is moved from a position laterally aligned with the base to a position overlying the base.

14. The vent as defined in claim 10, wherein said locking structure to secure the cover in overlying relation to the base includes a projection on the outer surface of the cover to engage said lock member, said cover being constructed of material sufficiently flexible to enable a peripheral portion of the cover to be displaced for engaging and disengaging the lock device by manipulating said projection on the cover.

15. The vent as defined in claim 1, wherein said base has an outer periphery and said cover has an outer periphery and the base outer periphery and cover outer periphery have approximately the same radius.

16. The vent as defined in claim 15, wherein said base has an annular configuration and said cover is of dome shaped configuration.

17. The vent as defined in claim 3, wherein said molded one piece construction of said base with said dome shaped cover being laterally aligned and connected by said hinge enables a plurality of said vents to be oriented in stacked, partially nested relation for storage and packaging in a compact condition.

18. The vent as defined in claim 1, wherein said locking structure interconnects peripheral portions of the base and cover in peripherally spaced relation to the hinge for securing the cover in overlying relation to the base.

19. A louvered vent attached to an outer surface of a flexible panel adapted to cover and enclose a space occupied by items in which it is desired to provide ventilation through an opening in the cover, said vent comprising a base having an opening therein attached to the cover around the periphery of the opening in the cover, said base being adhesively mounted on the cover with the opening in the base in alignment with the opening in the cover, a closure member for the vent opening in the base, said closure member being hingedly connected to the base and lockingly retained in overlying closed relation to the vent opening in the base, said closure member being in the form of a dome shaped wall having a plurality of louvers in spaced relation to define slot openings for air flow through the vent, said louvers being staggered and overlapping in a manner to shed water while permitting air flow, said louvered vent being constructed of one piece plastic material.

20. The louvered vent as defined in claim 19, wherein said vent is adapted to be stacked and partially nested when formed to enable a plurality of vents to be stored in a compact condition.

* * * * *